US008272703B2

(12) United States Patent
Jang

(10) Patent No.: US 8,272,703 B2
(45) Date of Patent: Sep. 25, 2012

(54) HOME-BAR DOOR AND THE MANUFACTURING METHOD

(75) Inventor: Woo Jin Jang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1117 days.

(21) Appl. No.: 12/061,541

(22) Filed: Apr. 2, 2008

(65) Prior Publication Data

US 2008/0238279 A1 Oct. 2, 2008

(30) Foreign Application Priority Data

Apr. 2, 2007 (KR) ..... 10-2007-0032245

(51) Int. Cl.
*A47B 97/00* (2006.01)

(52) U.S. Cl. ..... 312/405.1; 312/292

(58) Field of Classification Search ..... 312/405, 312/405.1, 292, 327, 328; 52/784.1, 784.12, 52/784.13, 784.15, 794.1; 428/167, 76, 71
See application file for complete search history.

(56) References Cited

U.S. PATENT DOCUMENTS

| | | | | |
|---|---|---|---|---|
| 1,805,038 | A * | 5/1931 | Derr | 428/71 |
| 3,309,500 | A * | 3/1967 | Reynolds | 392/435 |
| 3,729,879 | A * | 5/1973 | Franklin | 52/406.2 |
| 4,087,143 | A * | 5/1978 | Barnard et al. | 312/329 |
| 4,137,116 | A * | 1/1979 | Miller | 156/269 |
| 5,783,280 | A * | 7/1998 | Rendall et al. | 428/131 |
| 6,191,057 | B1 * | 2/2001 | Patel et al. | 442/398 |
| 2002/0014818 | A1 * | 2/2002 | Nishimoto | 312/400 |
| 2006/0138920 | A1 * | 6/2006 | Jang | 312/405 |
| 2006/0226750 | A1 * | 10/2006 | Lee et al. | 312/405.1 |
| 2007/0114812 | A1 * | 5/2007 | Hunt | 296/181.6 |
| 2010/0024464 | A1 * | 2/2010 | Hwang et al. | 62/377 |
| 2010/0095625 | A1 * | 4/2010 | Boutaghou et al. | 52/506.01 |

FOREIGN PATENT DOCUMENTS

| | | | |
|---|---|---|---|
| EP | 2172724 | * | 4/2010 |
| JP | 2000199212 | * | 7/2000 |
| WO | 2006098591 | * | 9/2006 |

OTHER PUBLICATIONS

English Abs for KR 2010001115 to Jun Jan. 6, 2010.*
English Abs for KR 2009080310 to Jun Jul. 24, 2009.*
English Abs for KR 2010043815 to Jang et al Apr. 29, 2010.*

* cited by examiner

*Primary Examiner* — Janet M Wilkens
(74) *Attorney, Agent, or Firm* — Birch Stewart, Kolasch & Birch, LLP

(57) ABSTRACT

Provided is a home-bar door and a method of manufacturing the home-bar door. The home-bar door includes a first case, an insulating plate, and a second case. The first case forms a portion of an exterior of the home-bar door, and the insulating plate is disposed in the first case as a separate component. The second case is configured to be coupled to the first case to cover the insulating plate and form the exterior of the home-bar door. Therefore, since the first and second cases can be coupled to each other after disposing the insulating plate between the first and second cases, the home-bar door can be efficiently manufactured and have good quality.

4 Claims, 4 Drawing Sheets

[fig.1]
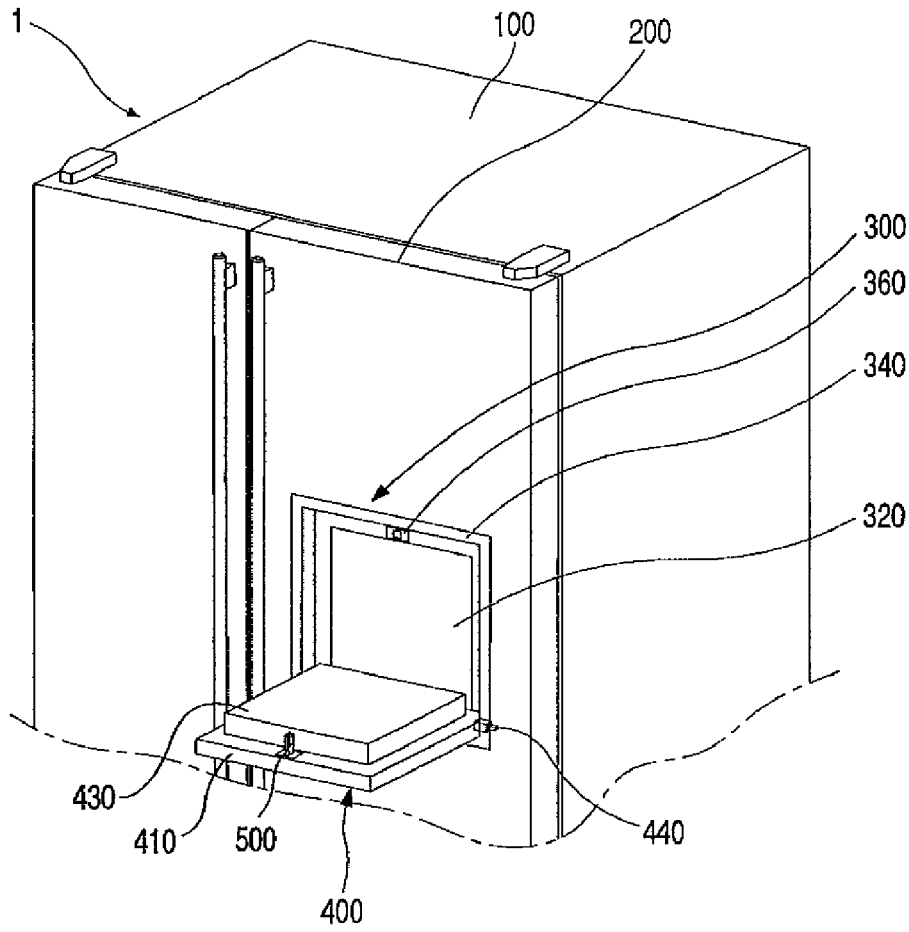
[fig.2]
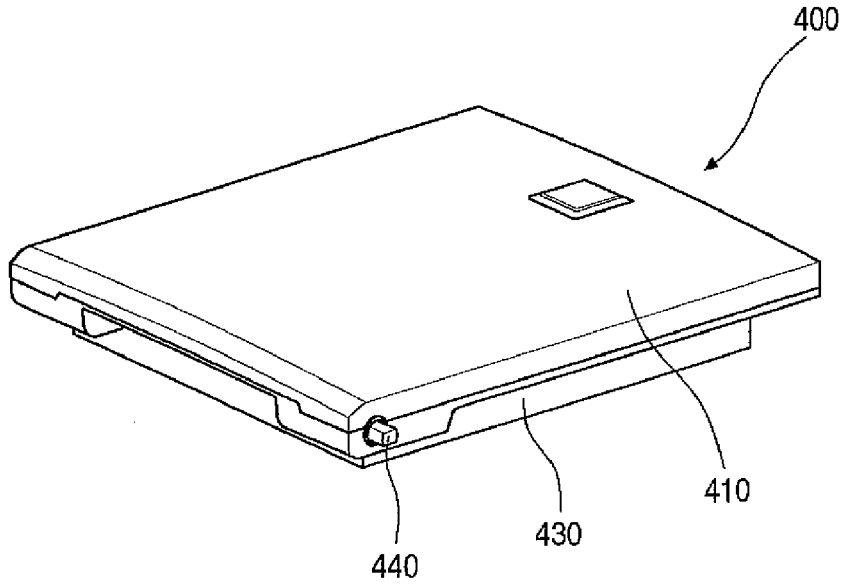

[fig.3]
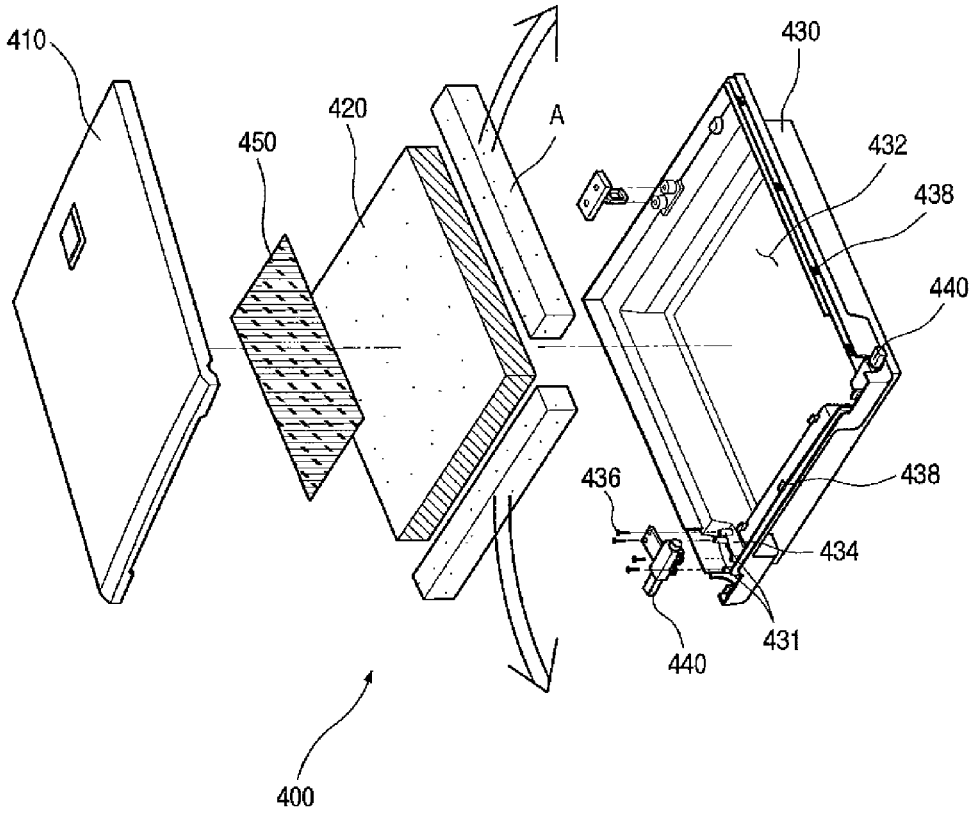

[fig.4]
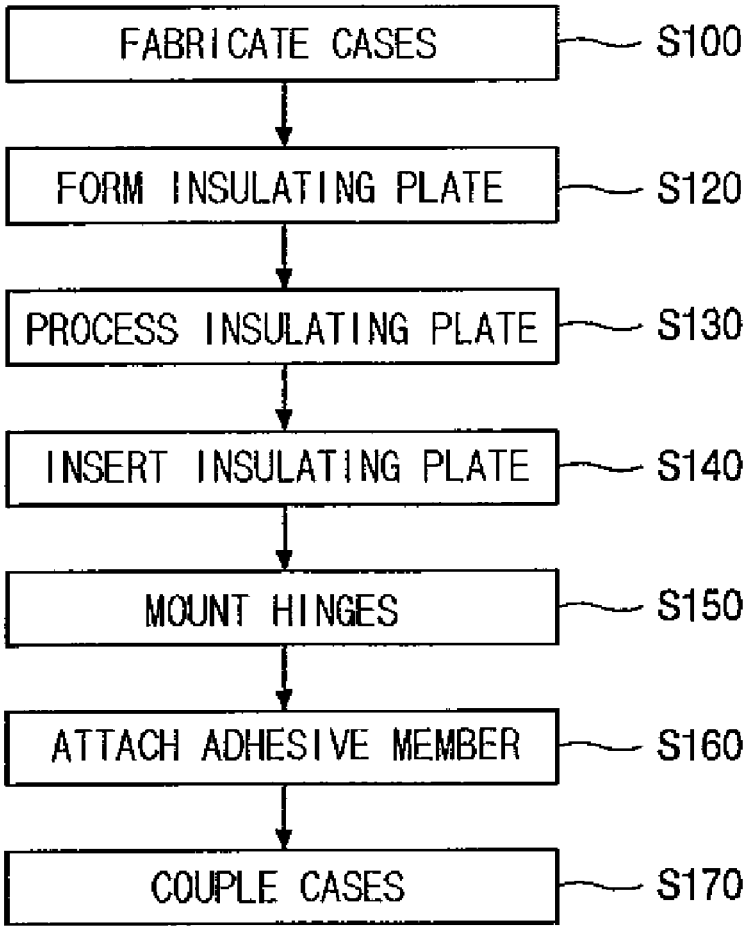

[fig.5]
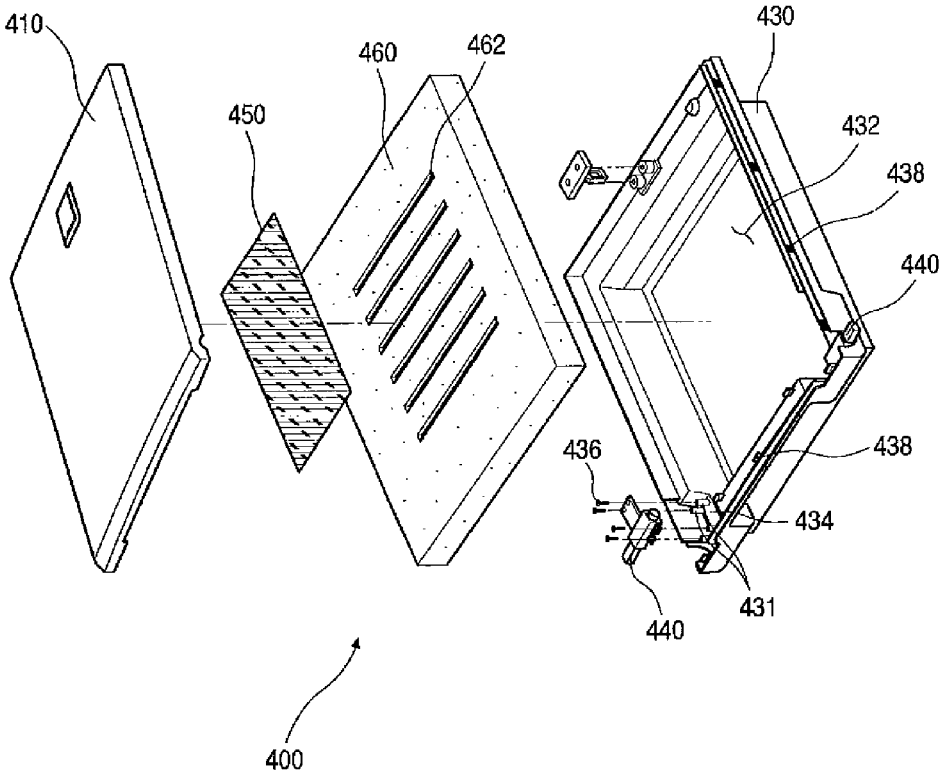
[fig.6]
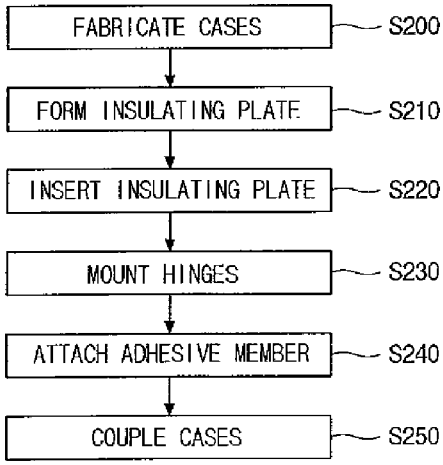

HOME-BAR DOOR AND THE MANUFACTURING METHOD

CROSS-REFERENCE TO RELATED APPLICATIONS

The present application claims priority under 35 U.S.C. 119 and 35 U.S.C. 365 to Korean Patent Application No 10-2007-0032245 filed on Apr. 2, 2007, filed which is hereby incorporated by reference in its entirety.

BACKGROUND

The present disclosure relates to a home-bar door and a method of manufacturing the home-bar door.

Generally, a home bar is provided at a door of a refrigerator to allow a user to take food from the inside of the refrigerator without opening the door.

The home bar may include an opening formed through the door of the refrigerator, a home-bar door disposed at the opening and rotatable independent of the door, and a hinge allowing the home-bar door to rotate on a lower edge portion of the opening.

The home-bar door includes a front case, a rear case, and an insulating member. The front case forms the front exterior of the home-bar door, and the rear case forms the rear exterior of the home-bar door. The insulating member is disposed between the front case and the rear cases. The insulating member can be formed by filling a foaming material between the front and rear cases. In this case, the hinge can be installed on the home-bar door by placing the hinge between the front and rear cases and filling the foaming material between the front and rear cases to securely fix the hinge.

For this, a foaming material injection hole may be formed through one of the front and rear cases, and the foaming material may be injected between the front and rear cases through the foaming material injection hole after fixing the front and rear cases using a jig.

The foaming material injected between the front and rear cases covers a portion of the hinge and is formed into the insulating member by foaming. Since the hinge is fixed between the front and rear cases in this way, outer air can be prevented from entering into the refrigerator through a gap around the hinge.

However, the related-art home-bar door has the following disadvantages.

While the foaming material is being injected between the front and rear cases of the home-bar door or is being formed into the insulating material by foaming, the front and rear cases can be departed or deformed. That is, the home-bar door can be deformed, and thus the home-bar door cannot be smoothly opened and closed due to dimensional mismatch with the door of the refrigerator.

Furthermore, since the front and rear cases are fixed to a jig when the foaming material is injected between the front and rear cases of the home-bar door, the front and rear cases can be scratched, thereby making the cosmetic appearance of the home-bar door poor.

Moreover, it takes much time until the foaming material is fully formed into the insulating member by foaming.

In addition, when the foaming material is injected between the front and rear cases through the foaming material injection hole, the hinge placed between the front and rear cases of the home-bar door can be moved by the pressure of the foaming material. In this case, the home-bar door may be improperly installed on the door of the refrigerator and abnormally operated.

SUMMARY

In one embodiment, a home-bar door includes: a first case forming a portion of an exterior of the home-bar door; an insulating plate disposed in the first case as a separate component; and a second case configured to be coupled to the first case to cover the insulating plate and form the exterior of the home-bar door.

In another embodiment, there is provided a method of manufacturing a home-bar door, the method including: fabricating first and second cases forming an exterior of the home-bar door; forming an insulating plate adapted to be disposed between the first and second cases for preventing heat transfer; cutting the insulating plate into a size adapted to be disposed between the first and second cases when the first and second are coupled; inserting the insulating plate between the first and second cases; and coupling the first and second cases to each other.

In a further embodiment, there is provided a method of manufacturing a home-bar door, the method including: fabricating first and second cases forming an exterior of the home-bar door; forming an insulating plate into a shape corresponding to a shape of a space formed between the first and second cases through a foaming process using a separate mold so as to dispose the insulating plate between the first and second cases; inserting the insulating plate between the first and second cases; and coupling the first and second cases to each other.

The details of one or more embodiments are set forth in the accompanying drawings and the description below. Other features will be apparent from the description and drawings, and from the claims.

BRIEF DESCRIPTION OF THE DRAWINGS

FIG. 1 is a partial perspective view illustrating a refrigerator including a home-bar door according to an embodiment.

FIG. 2 is a perspective view illustrating the home-bar door according to an embodiment.

FIG. 3 is an exploded perspective view illustrating the home-bar door according to an embodiment.

FIG. 4 is a flowchart for explaining a method of manufacturing a home-bar door according to an embodiment.

FIG. 5 is an exploded perspective view illustrating a home-bar door according to another embodiment.

FIG. 6 is a flowchart for explaining a method of manufacturing a home-bar door according to another embodiment.

DETAILED DESCRIPTION OF THE EMBODIMENTS

Reference will now be made in detail to the embodiments of the present disclosure, examples of which are illustrated in the accompanying drawings. The present disclosure may, however, be embodied in many different forms and should not be construed as being limited to the embodiments set forth herein.

Home-bar doors and methods of manufacturing the home-bar doors that are described in the present disclosure can be applied to various refrigerators having a home bar. In the following description, a side-by-side refrigerator will be explained as an example of such refrigerators.

FIG. 1 is a partial perspective view illustrating a refrigerator 1 including a home-bar door 400 according to an embodiment. FIG. 1 shows an opened state of a home bar 300 of the refrigerator.

Referring to FIG. 1, the refrigerator 1 includes a main body 100 having a hexahedral shape. The main body 100 forms the exterior of the refrigerator 1. A storage room is formed inside the main body 100 for storing food. The storage room is divided into left and right compartments. One of the compartments is a refrigerator compartment, and the other is a freezer compartment.

Doors 200 are attached to a front side of the main body 100. The doors 200 are used to close and open a front opening formed in the front side of the main body 100. That is, the doors 200 are used to selectively close and open the refrigerator and freezer compartments of the storage room of the main body 100. For this, the doors 200 are rotatably attached to left and right edge portions of the main body 100, respectively. When the doors 200 are closed, the doors 200 form the front exterior of the refrigerator 1.

The home bar 300 is provided at least one of the doors 200 to allow a user to put food into the refrigerator 1 and take the food out of the refrigerator 1 without opening the doors 200.

The home bar 300 includes an opening 320 formed through the door 200, the home-bar door 400 rotatably attached to a lower edge of the opening 320 for selectively opening and closing the opening 320, and hinges 440 configured to allow rotation of the home-bar door 400.

In detail, the opening 320 may be formed through the door 200 into a rectangular shape to connect the storage room of the refrigerator 1 to the outside of the refrigerator 1. A basket may be disposed on an inner surface of the door 200 close to the opening 320. In this case, a user can place food on the basket and access the food easily.

A rectangular home-bar frame 340 is disposed at the opening 320. The home-bar frame 340 is disposed on the door 200 around the opening 320. The hinges 440 are rotatably coupled to a side of the home-bar frame 340 so that the home-bar door 400 can be rotated on the home-bar frame 340.

The home-bar frame 340 may have a width corresponding to the thickness of the door 200. The home-bar frame 340 may have stepped inner surfaces. In other words, rear portions of the inner surfaces may protrude inwardly so as to provide a reliable sealing effect when the home-bar door 400 is closed.

A latch assembly 360 is disposed at an upper center portion of the home-bar frame 340. When the home-bar door 400 is closed, the latch assembly 360 couples with a corresponding striker 500 disposed on the home-bar door 400 to lock the home-bar door 400. For this, the latch assembly 360 and the striker 500 may be a proper locking/releasing structure.

For example, the striker 500 can be locked into the latch assembly 360 by pushing the home-bar door 400 toward the home-bar frame 340. Then, the striker 500 can be released from the latch assembly 360 by pushing the home-bar door 400 toward the home-bar frame 340 once. A well-known locking/releasing structure can be used for the latch assembly 360 and the striker 500. A detailed description of the well-known locking/releasing structure will be omitted.

The home-bar door 400 has a size corresponding to the size of the opening 320 to close the opening 320. The home-bar door 400 has a stepped peripheral surfaces corresponding to the stepped inner surfaces of the home-bar frame 340. Therefore, the home-bar door 400 can make tight contact with the home-bar frame 340 for reliable sealing. The hinges 440 protrude from both sides of a lower edge portion of the home-bar door 400 and are rotatably coupled to the home-bar frame 340 so that the home-bar door 400 can be rotated on the home-bar frame 340.

FIG. 2 is a perspective view illustrating the home-bar door 400 according to an embodiment, and FIG. 3 is an exploded perspective view illustrating the home-bar door 400 according to an embodiment. The home-bar door 400 will now be described in more detail with reference to FIGS. 2 and 3.

The home-bar door 400 includes a first case 430, an insulating plate 420, the hinges 440, and a second case 410. The first case 430 has a size and shape corresponding to the size and shape of the opening 320. The insulating plate 420 is disposed in the first case 430. The hinges 440 are installed on the first case 430 to allow rotation of the home-bar door 400. The second case 410 is coupled to the first case 430 to cover the hinges 440 and the insulating plate 420.

The first case 430 forms a portion of the rear side of the home-bar door 400. The first case 430 has a shape corresponding to that of the opening 320 so that the first case 430 can be tightly coupled to the home-bar frame 340 for closing the opening 320. The first case 430 has an opened front side. Peripheral surfaces of the first case 430 are stepped like the inner surfaces of the home-bar frame 340.

A plate accommodation portion 432 is formed in the first case 430 to receive the insulating plate 420. Hinge installation portions 434 are disposed at both sides of a lower edge portion of the first case 430 for mounting the hinges 440.

A plurality of coupling holes 431 are formed in each of the hinge installation portions 434. The coupling holes 431 have a shape corresponding to the shape of fasteners 436 such as screws so that the fasteners 436 can be coupled to the coupling holes 431 to fix the hinges 440.

A plurality of hooking protrusions 438 are disposed along front edges of the first case 430 so that the first case 430 can be coupled with the second case 410 by tight fitting.

The insulating plate 420 is disposed in the first case 430 to prevent heat transfer across the home-bar door 400. The insulating plate 420 may be formed of polystyrene foam.

The insulating plate 420 is prepared through a separate foaming process and then assembled with the first and second cases 430 and 410. The insulating plate 420 can be formed by cutting an insulating material into a size corresponding to the size of the plate accommodation portion 432 of the first case 430. Then, the insulating plate 420 can be placed in the plate accommodation portion 432.

For example, as shown in FIG. 4, the insulating plate 420 can be formed by cutting a standard size insulating material into a size corresponding to the size of the plate accommodation portion 432, and then the insulating plate 420 can be inserted into the plate accommodation portion 432. That is, after cutting unnecessary portions (A) off the standard size insulating material, the remaining portion is placed in the plate accommodation portion 432 as the insulating plate 420.

The insulating plate 420 may be formed of a piece of insulating material having a shape corresponding to the shape of the plate accommodation portion 432. Alternatively, the insulating plate 420 may be formed of a plurality of pieces of insulating material. For example, if the shape of the plate accommodation portion 432 is complex, it may be easier to place the insulating plate 420 in the plate accommodation portion 432 when the insulating plate 420 is formed of a plurality of pieces of insulating material.

An adhesive member 450 such as a double-sided tape or an adhesive material may be disposed on at least one of front and rear sides of the insulating plate 420. The adhesive member 450 may be disposed between the insulating plate 420 and at least one of the first and second cases 430 and 410 for securable contact therebetween.

The second case 410 forms the front exterior of the home-bar door 400. The second case 410 has a rectangular shape corresponding to the shape of the opening 320. The second case 410 is coupled to the first case 430. Edges of the second case 410 protrude backward so that the second case 410 can be coupled with the second case 410 by inserting the hooking protrusions 438 of the second case 410 into the backwardly protruding edges of the first case 430.

The insulating plate 420 disposed in the plate accommodation portion 432 of the first case 430 makes contact with inner surfaces of the second case 410 when the first case 430 is coupled with the second case 410. In addition, since the insulating plate 420 is adhered to at least one of the first and second cases 430 and 410 by the adhesive member 450, when the home-bar door 400 is rotated, the insulating plate 420 does not move in the home-bar door 400, and the at least one of the first and second cases 430 and 410 does not come off the insulating plate 420.

Alternatively, the insulating plate 420 may be accommodated in the second case 410 instead of the first case 430. Alternatively, the insulating plate 420 can be accommodated in both the first and second cases 430 and 410. Whether the insulating plate 420 is accommodated in the first case 430 or the second case 410 may be determined by the shapes of the first and second cases 430 and 410.

A method of manufacturing a home-bar door will now be described.

FIG. 4 is a flowchart for explaining a method of manufacturing the home-bar door 400 according to an embodiment.

Referring to FIGS. 1 to 4, the method begins with operation S100 for fabricating the second case 410 and the first case 430.

In operation S100, the first case 430 is formed into a size and shape corresponding to the size and shape of the opening 320 formed in the door 200 of the refrigerator 1 by injection molding, and the second case 410 corresponding to the first case 430 is formed by injection molding.

In operation S120, the insulating plate 420 is formed through a separate process. For example, the insulating plate 420 is formed by injecting a foaming material into a mold and allowing the foaming material to foam.

In this way, the insulating plate 420 is formed through a well-known process. Alternatively, a standard insulating plate available in the market can be prepared as the insulating plate 420 instead of forming the insulating plate 420 through a separate process.

In operation S130, the insulating plate 420 is processed by, for example, machining.

In detail, the insulating plate 420 may be sized to the size of the first case 430. For example, the insulating plate 420 can be cut into a size corresponding to the size of the first case 430.

In operation S140, the insulating plate 420 is inserted into the plate accommodation portion 432 of the first case 430. In operation S150, the hinges 440 are installed on the hinge installation portions 434 of the first case 430.

Thereafter, in operation S160, the adhesive member 450 such as an adhesive material and a double-sided tape is attached to a front side of the insulating plate 420. Alternatively, in operation S160, the adhesive member 450 may be attached to a rear side of the insulating plate 420 to bond the insulating plate 420 and the first case 430. In this case, operation S160 may be performed prior to operation S140.

After operations S150 and S160 are performed, the second case 410 is coupled to the first case 430 in operation S170. The insulating plate 420 can be bonded to the second case 410 by the adhesive member 450 after the second case 410 is coupled to the first case 430 in operation S170. In this way, the home-bar door 400 can be manufactured.

The home-bar door 400 manufactured in the way is mounted on the home-bar frame 340 of the door 200 using the hinges 440 such that the home-bar door 400 can be rotated on the home-bar frame 340.

A home-bar door and a method of manufacturing the home-bar door will now be described according to other embodiments.

In the following description, the same elements as those of the above-described embodiments will be denoted by the same reference numerals, and detailed descriptions of the same elements will be omitted.

FIG. 5 is an exploded perspective view illustrating a home-bar door 400 according to another embodiment.

Referring to FIG. 5, the home-bar door 400 has a shape corresponding to the shape of the opening 320 formed through the door 200 of the refrigerator 1. The home-bar door 400 includes hinges 440, a second case 410, a first case 430, and an insulating plate 460 disposed between the first case 430 and the second case 410.

The first case 430 has a shape corresponding to the shape of the home-bar frame 340 so that the first case 430 can be brought into tight contact with the home-bar frame 340. A plate accommodation portion 432 is formed in the first case 430 to receive the insulating plate 460. Hinge installation portions 434 are formed at both sides of a lower edge portion of the first case 430 for mounting the hinges 440. That is, the hinges 440 are installed at both sides of a lower edge portion of the home-bar door 400.

The insulating plate 460 has a shape corresponding to the shape of the plate accommodation portion 432. The insulating plate 460 may be fabricated using a mold having a shape corresponding to the shape of the plate accommodation portion 432. Then the insulating plate 460 may be inserted in the plate accommodation portion 432 of the first case 430 before the first case 430 and the second case 410 are coupled.

In detail, the insulating plate 460 may be fabricated by filling a foaming material in a mold having a shape corresponding to the shape of the plate accommodation portion 432 of the first case 430 and allowing the foaming material to foam. After forming the insulating plate 460 into a shape corresponding to the shape of the plate accommodation portion 432 using the mold, the insulating plate 460 can be inserted into the plate accommodation portion 432.

A deformation prevention portion 462 is formed in a front side of the insulating plate 460 so as to prevent deformation of the insulating plate 460 when the insulating plate 460 foams in the mold. A plurality of long slots can be uniformly formed in the front side of the insulating plate 460 as the deformation prevention portion 462. The slots may be arranged at regular intervals.

When the insulating plate 460 is cooled during or after foaming, the insulating plate 460 can uniformly shrink owing to the deformation prevention portion 462. Therefore, formation of a belly portion on the insulating plate 460 can be prevented. Furthermore, when the insulating plate 460 is inserted into the plate accommodation portion 432, the insulating plate 460 can be easily deformed according to the shape of the plate accommodation portion 432 owing to the deformation prevention portion 462. Therefore, the insulating plate 460 can be easily inserted into the plate accommodation portion 432.

An adhesive member 450 is attached to the front side of the insulating plate 460 so as to prevent the second case 410 from coming off or releasing from the first case 430 when the second case 410 is coupled to the first case 430. The adhesive member 450 may be bonded between the front side of the insulating plate 460 and an inner surface of the second case 410. The adhesive member 450 may be a double-sided tape or an adhesive material.

The second case 410 is coupled to the first case 430 from the top of the first case 430. The second case 410 forms the front exterior of the home-bar door 400. The second case 410 has a shape corresponding to the shape of the opening 320 for selectively closing and opening the opening 320.

A method of manufacturing the home-bar door 400 will now be described according to another embodiment with reference to FIG. 6.

FIG. 6 is a flowchart for explaining a method of manufacturing a home-bar door according to another embodiment. Referring to FIG. 6, in operation S200, the first case 430 forming the rear side of the home-bar door 400 and the second case 410 the front side of the home-bar door 400 are fabricated.

In detail, the first case 430 is formed into a size and shape corresponding to the size and shape of the opening 320 formed in the door 200 of the refrigerator 1 by injection molding, and the second case 410 is formed into a shape corresponding to the front shape of the first case 430 by injection molding. Here, the hinge installation portions 434 are formed on both sides of a lower edge portion of the first case 430.

In operation S210, the insulating plate 460 is formed into a shape corresponding to the shape of an inside portion of the first case 430 through a process independent of operation S200. For example, the insulating plate 460 is formed by injecting a foaming material into a mold having a shape corresponding to the shape of the inside portion (i.e., the plate accommodation portion 432) of the first case 430 and allowing the foaming material to foam.

In operation S220, the insulating plate 460 is inserted into the first case 430. In operation S230, the hinges 440 are mounted on the hinge installation portions 434 of the first case 430.

Operations S220 and S230 can be performed in this order or in a reverse order. After operations S220 and S230 are performed, the second case 410 and the first case 430 are coupled in operation S250.

Before the second case 410 and the first case 430 are coupled, in operation S240, an adhesive member 450 is attached to a front side of the insulating plate 460 inserted in the first case 430.

When the second case 410 is coupled to the first case 430, the adhesive member 450 bonds the front side of the insulating plate 460 to the inner surface of the second case 410. Therefore, the second case 410 can be prevented from coming off.

Thereafter, operation S250 is performed as described above to couple the second case 410 to the first case 430. In this way, the home-bar door 400 can be manufactured.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home-bar door comprising:

a first case forming a portion of an exterior of the home-bar door;

an insulating plate disposed in the first case as a separate component; and a second case configured to be coupled to the first case to cover the insulating plate and form the exterior of the home-bar door, wherein the second case is coupled to the first case, after the insulating plate is disposed in the first case, wherein the insulating plate comprises a deformation prevention portion formed by inwardly recessing a portion of a side of the insulating plate to prevent deformation of the insulating plate, wherein the insulating plate is cut into a size corresponding to the size of the first case, after forming the insulating plate into a shape corresponding to the shape of a space between the first case and the second case using a mold, and wherein the home-bar door further comprises an adhesive member disposed between the insulating plate and at least one of the first and second cases for securable contact therebetween.

2. The home-bar door according to claim 1, wherein the first case comprises a plate accommodation portion having a shape corresponding to a shape of the insulating plate for receiving the insulating plate.

3. The home-bar door according to claim 1, further comprising hinges on both sides of lower edge portions of the first and second cases for allowing rotatable installation of the home-bar door.

4. The home-bar door according to claim 1, wherein the deformation prevention portion comprises a plurality of recesses extending between edges of the insulating plate, and wherein ends of the recesses are spaced from the edges of the insulating plate.

* * * * *